US008616035B2

(12) United States Patent
Tuschhoff

(10) Patent No.: US 8,616,035 B2
(45) Date of Patent: Dec. 31, 2013

(54) METHOD FOR CONTROLLING LATERAL GUIDING DEVICES FOR A METAL STRIP

(75) Inventor: Matthias Tuschhoff, Siegen (DE)

(73) Assignee: SMS Siemag Aktiengesellschaft, Düsseldorf (DE)

( * ) Notice: Subject to any disclaimer, the term of this patent is extended or adjusted under 35 U.S.C. 154(b) by 0 days.

(21) Appl. No.: 13/520,015

(22) PCT Filed: Dec. 22, 2010

(86) PCT No.: PCT/EP2010/070473

§ 371 (c)(1),
(2), (4) Date: Jul. 16, 2012

(87) PCT Pub. No.: WO2011/080174

PCT Pub. Date: Jul. 7, 2011

(65) Prior Publication Data

US 2012/0279267 A1 Nov. 8, 2012

(30) Foreign Application Priority Data

Dec. 29, 2009 (DE) ..... 10 2009 060 826

(51) Int. Cl.
*B21B 37/00* (2006.01)

(52) U.S. Cl.
USPC ..... 72/14.4; 72/14.1; 700/150

(58) Field of Classification Search
USPC ..... 72/8.1, 10.1, 10.4, 13.1, 12.1, 13.2, 72/13.3, 234, 250, 226, 227, 13.4, 14.4, 72/14.1, 14.5, 9.3, 1.9; 700/148, 150
See application file for complete search history.

(56) References Cited

U.S. PATENT DOCUMENTS

| | | | | |
|---|---|---|---|---|
| 5,077,997 | A * | 1/1992 | Wolters et al. | 72/9.2 |
| 6,000,259 | A * | 12/1999 | Wolters et al. | 72/13.3 |
| 6,308,547 | B1 * | 10/2001 | Heess et al. | 72/107 |
| 2006/0144831 | A1 * | 7/2006 | Schmidt et al. | 219/121.72 |
| 2008/0141668 | A1 * | 6/2008 | Micklisch | 60/413 |

FOREIGN PATENT DOCUMENTS

| | | | | |
|---|---|---|---|---|
| DE | 3116278 | A1 | 11/1982 | |
| DE | 3240692 | A1 * | 5/1984 | B21B 39/14 |
| DE | 4003717 | A1 | 8/1991 | |
| DE | 69829454 | T2 | 4/2006 | |
| EP | 0925854 | A2 | 6/1999 | |
| GB | 2100475 | A | 11/2002 | |
| JP | 61108415 | A | 5/1986 | |
| JP | 2235519 | A | 9/1990 | |

* cited by examiner

*Primary Examiner* — Dana Ross
*Assistant Examiner* — Pradeep C Battula
(74) *Attorney, Agent, or Firm* — Lucas & Mercanti, LLP; Klaus P. Stoffel

(57) ABSTRACT

The invention relates to a method for controlling a lateral guiding device for a metal strip (1), the lateral guiding device comprising a guide (2, 4) disposed laterally to the metal band (1) on both sides thereof, it being possible for the two guides (2, 4) to be displaced independently of each other, and both guides (2, 4) being operated in a position-controlled manner, forces of the metal strip that act on a first guide (2) of the two guides (2, 4) and on a second guide (4) of the two guides (2, 4) being measured, and the target position for the first and/or the second guide (2, 4) being controlled as a function of the forces measured at the first and at the second guide (2, 4), such that the lesser value of the forces measured at the first guide (2) and at the second guide (4) is above a selectable lower limit force and below a selectable upper limit force.

8 Claims, 3 Drawing Sheets

METHOD FOR CONTROLLING LATERAL GUIDING DEVICES FOR A METAL STRIP

The present application is a 371 of International application PCT/EP2010/070473, filed Dec. 22, 2010, which claims priority of DE 10 2009 060 826.5, filed Dec. 29, 2009, the priority of these applications is hereby claimed and these applications are incorporated herein by reference.

BACKGROUND OF THE INVENTION

The invention relates to a method for regulating the lateral guides of a metal strip, particularly in rolling plants, for example, in the entry or exit of roll stands or in front of driving apparatus, or also in other strip processing lines.

Methods for regulating the lateral guides of a metal strip, are already known from the prior art. Such guides usually consist of two rulers arranged laterally of the path of the strip which are positioned by means of hydraulic cylinders and can be pressed against the strip and adjusted relative to the strip as the strip travels through. The known systems frequently have a mechanical coupling of both rulers as well as a common regulation for their adjustment. While such systems are relatively easy to conceptionalize, their adjustment possibilities, and particularly their regulation, are very limited. Not all strip patterns can be corrected sufficiently. Damage to the metal strips and the rulers cannot always be sufficiently avoided.

Moreover, methods are known in which, during the guidance of a strip, one ruler is operated in a position-regulated manner, while the other ruler is pressed with a defined force against the strip. The determination of the pressing force between the ruler and strip is, in this method, carried out for both sides. During the guidance of the strip, the ruler is held on one side in a position-regulated manner at a fixed position. The other ruler is pressed in a force-regulated manner with a defined force against the strip. The desired force of the force-regulated ruler is fixedly preset in dependence on properties of the strip to be guided, such as material, width, thickness, temperature or speed. This desired force is selected in such a way that it is always greater than the contact force of the strip on the force-regulated side because otherwise, the guide on this side could be opened by the strip. A disadvantage of this method is the fact that when the strip exerts a force against the position-regulated side, the reaction force and additionally the preset force on the force-regulated side, must be absorbed. Damage to the strip and also to the rulers is the result. Consequently, for the repair of the rulers long idle times of the plant are unavoidable. In addition, another disadvantage of this method results from the fact that the width of the strip to be guided is generally not constant. By presetting a fixed desired force independently of the width of the strip to be guided, the rulers cannot be adequately adjusted to different strip width patterns, so that at best, the guidance is inadequate or such high forces occur between strip and rulers that significant damage occurs.

The Laid Open Application DE 4003717 A1 discloses another method for the lateral guidance of a rolled strip. It is the object of the disclosed method to increase the service life of the guide rulers in a roller conveyor. For this purpose, a regulation of the guide rulers is proposed which operates in such a way that it alternatingly can be pressed against the edges of the strip, and then can be lifted off from the edges. Among others, this method has the disadvantage that the desired values for a force-regulated loop are preset by a process computer in accordance with an input, and the regulation can, in many cases, not take place with sufficient accuracy. Because of the preset desired forces, this method also has the above-mentioned disadvantage that this method still causes fast unsatisfactory wear, and additionally, significant strip edge damage may occur.

The publication DE 698 29 454 T2 discloses a method for regulating the lateral guidance of a metal strip.

The technical object, which results from the prior art, is consequently to be seen to make available an improved regulating method for lateral guides of metal strip, or at least to avoid the above-mentioned disadvantages.

SUMMARY OF THE INVENTION

The above-mentioned technical object is met by the method according to the invention for regulating a lateral guide for metal strip, wherein the lateral guide includes on one side of the metal strip a first ruler and on the other side of the metal strip a second ruler, wherein the rulers are movable independently of each other and can be operated in a position-controlled manner, and forces of the metal strip which act on the first and second rulers are measured and, in accordance with the invention, the desired position for the first and/or second ruler is regulated in dependence on the forces measured at the first and at the second ruler, such that the smaller value of the forces measured at the first and the second ruler respectively, is above a selectable lower limit force and below a selectable upper limit force. Because both rulers are operated with position control independently of each other and because the forces measured at the rulers for determining the desired position are used as described, damage to the rulers is reduced. Particularly in the case of stiff guides, the regulation according to the invention was found to be extremely advantageous. In addition, the regulation in accordance with the invention is particularly advantageous if the width of the strip varies.

In a preferred embodiment of the method according to the invention, the upper limit force is greater than the lower limit force. Moreover, this embodiment includes the feature according to which when the smaller value of the forces measured at the first ruler and measured at the second ruler is below the lower limit force, the positions for the first and/or the second ruler are adjusted in such a way that the forces measured at the first ruler and the forces measured at the second ruler are increased. Moreover, when the smaller value of the forces measured at the first ruler and at the second ruler exceeds the upper limit force, the positions for the first and/or second ruler are adjusted in such a way that the forces measured at the first ruler and at the second ruler are lowered. If the regulation is carried out in this manner, the forces between the strip and rulers are reduced particularly effectively, whereby the wear of the rulers is reduced and damage to the rulers can be even more effectively avoided.

In accordance with another preferred embodiment of the method according to the invention, the measured forces are filtered with a low pass filter. The low pass filtering makes it possible to operate the method reliably and not be subject to problems. High frequencies, which frequently are due to interferences, can be filtered out in this manner.

In accordance with another embodiment of the method according to the invention, the first and the second rulers are driven by a drive, wherein at least one of these drives optionally is carried out hydraulically or pneumatically.

In accordance with another embodiment of the method according to the invention, the hydraulic or pneumatic drives have two cylinder chambers, wherein the forces acting on the first or on the second ruler are determined by the pressures measured in the cylinder chambers.

In accordance with another embodiment of the method according to the invention, the first and the second rulers are driven by a drive, wherein at least one of these drives optionally is carried out by an electrical linear motor.

In accordance with another embodiment of the method according to the invention, the force which acts on the first or the second ruler is determined by measured electrical values of the linear motor.

In accordance with another embodiment of the method according to the invention, the first and the second rulers are driven by a drive, wherein at least one of these drives has a rotary motor and a spindle gear unit, and wherein the rotary motor is driven optionally hydraulically or pneumatically.

DETAILED DESCRIPTION OF THE INVENTION

Figure 1:
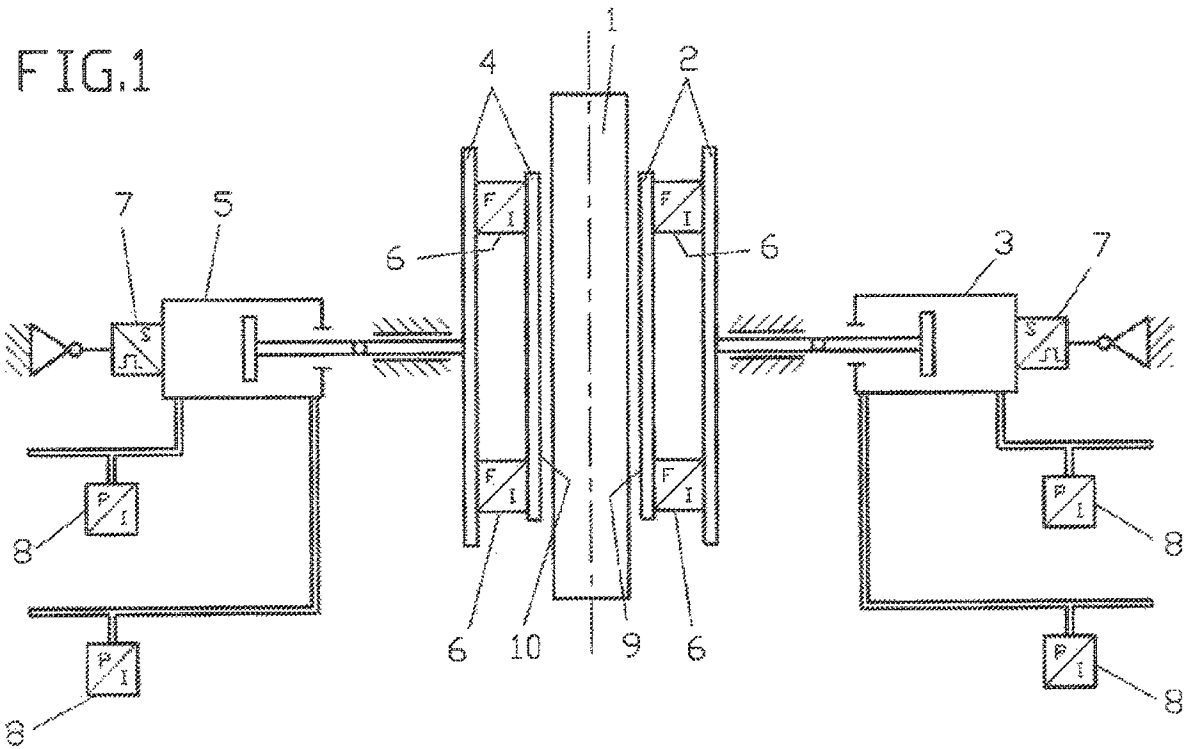
FIG. 1 is a schematic sketch of a lateral guide of a metal strip including control and regulating technology.
Figure 3:
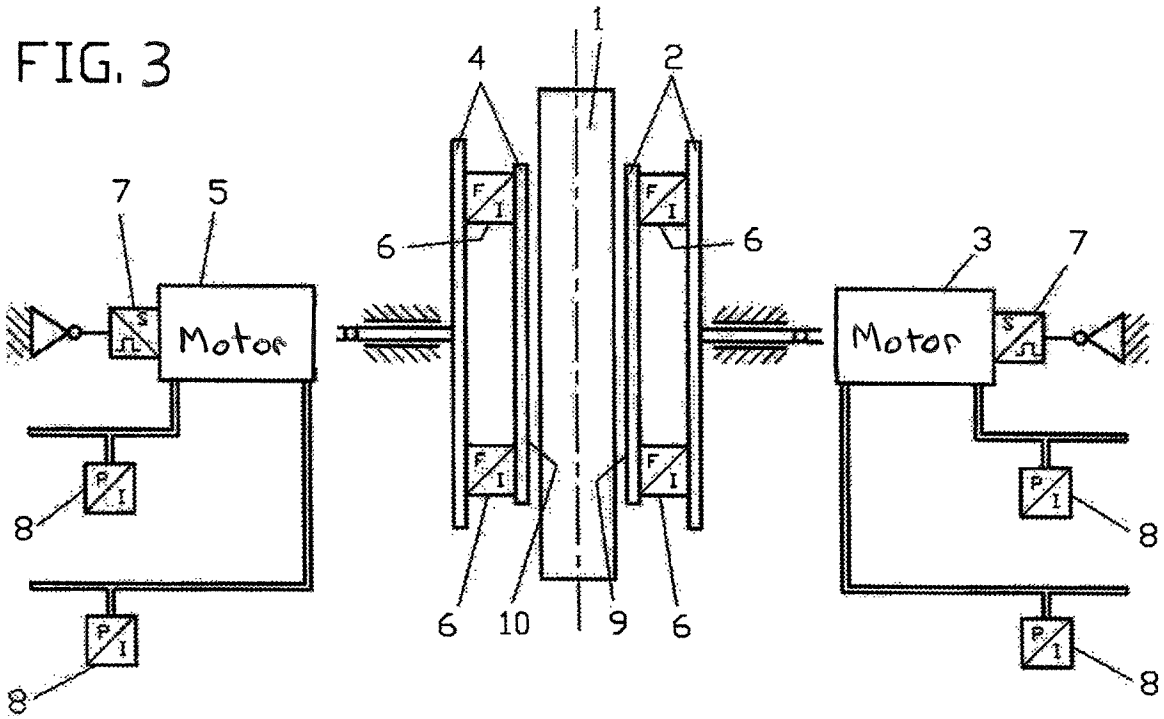
FIG. 3 is a view as is FIG. 1 with adjusting devices schematically shown as motors.

In FIG. 1, an example of an arrangement for carrying out the method according to the invention is shown. A metal strip 1, preferably a steel strip 1, is guided on both of its sides or longitudinal sides by lateral guides. Such lateral guides which are known per se each include a ruler 2, 4. The metal strip 1 can be contacted by the guide edges 9, 10 of the rulers 2, 4. The rulers 2, 4 are preferably adjusted laterally relative to the strip 1 by drives or adjusting devices 3, 5. It is optional, as shown in FIG. 1, to provide force measuring pick-ups 6 between the guide edges 9, 10 and the drives or adjusting devices 3, 5 of the rulers 2, 4. It is also possible that the rulers 2, 4 are constructed of several pieces, as shown. The adjusting devices 3, 5 can, for example, be formed by hydraulic or pneumatic cylinders, as illustrated. Moreover, as shown in FIG. 1, position measuring pick-ups 7 are provided which can measure the travel distance of the piston in the adjusting devices 3, 5. Alternatively, it is also possible to provide other position measuring pick-ups 7, for example, such that they determine the position of the rulers directly in contact with the rulers 2, 4. Also possible and advantageous are contactless position measurements, such as by means of electromagnetic waves. Also illustrated in FIG. 1 are pressure measuring devices 8 or pressure measuring pick-ups 8, which are able to measure pressure values in the piston/cylinder unit 3, 5. From these values conclusions can be drawn in accordance with known procedures with respect to forces K1, K2 which act on the rulers 2, 4. Alternatively, also in the case of a drive with a motor 3, 5, particularly a rotary motor, the torque of the motor can be used for determining forces acting on the rulers 2, 4 (See FIG. 3).

Figure 2:
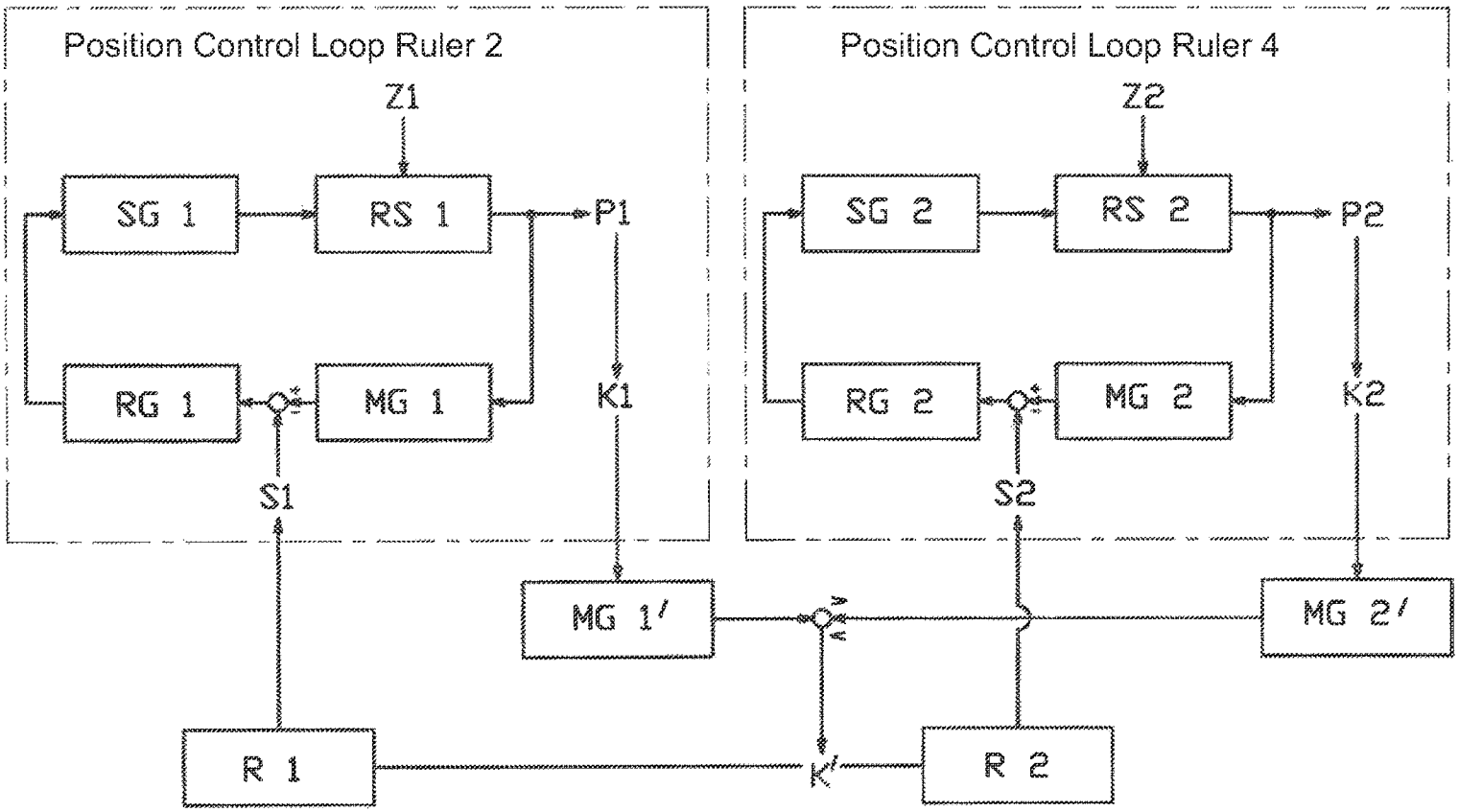
FIG. 2 is a regulation schematic.

FIG. 2 shows a control loop schematic which is intended to illuminate the method according to the invention as an example. On the left in FIG. 2, a position-regulated loop for the first ruler 2 is shown, and to the right, a position-regulating loop for the second ruler 4. By means of the position-regulating loop of the first ruler 2, the ruler 2 is to be held on an intended position S1. However, interference Z1, in the form of a pressure of the strip 1, acts on the regulating system RS1 of the regulating loop, i.e. on the ruler 2. This interference causes a resulting position P1 of the first ruler which can be determined by the measuring unit MG1. Such a measuring unit may be, for example, the position measuring pick-up 7. The measured value is then compared with the intended value S1 of the position of the ruler 2. If there is a difference between the actual value of the position P1 and the intended value of the position S1, this difference is transformed by a regulating unit RG1 into information for the adjusting member SG1. The adjusting member SG1 is preferably formed by one of the adjusting devices 3, 5 of FIG. 1. However, alternatively, the use of electrical or rotary motors is possible. The adjusting member SG1 finally, once again influences the regulating system RS1 or the ruler 2 and its position.

The position-regulating loop of the ruler 4, i.e. second ruler 4, operates analogously to the control loop just described. An interference value Z2, i.e. a pressure of the metal strip 1, acts on the regulating system RS2 of the position of the ruler 4. Altogether the position P2 of the ruler 4 is adjusted. This position P2 can be measured by the measuring unit MG2. Subsequently, this measured position P2 is compared to an intended position S2 of the ruler 4. An existing difference between these two values is transferred to the regulating unit RG2. As is conventional in regulating technology, this regulating unit RG2 issues an adjusting value to the adjusting unit SG2 which, consequently, has influence on the regulating system RS2, which closes the regulating loop.

In accordance with the invention, in addition to the position regulation on both sides of the metal strip 1, also those forces are measured which act on the rulers 2, 4. This means, in particular, that a force K1 exists for each position P1 and a force K2 exists for each position P2. These forces K1, K2 are also schematically characterized in FIG. 2 and are measured by the measuring units MG1' and MG2'. The measuring units MG1' and MG2' can preferably be formed by the force measuring pick-ups 6 or the measuring pick-ups 8. In a next step in the method according to the invention, the forces K1 measured at the first ruler 2 are compared to the forces K2 measured at the second ruler 4, wherein the smaller of the two forces K1 and K2, which in the following will be called the force K', and is preferably transferred to the regulators or regulating devices R1 and/or R2. In the event that K1 is the lower force and, thus, corresponds to the force K', this force is transferred to the regulator 1 which issues a changed intended value S1 for the position of the first ruler 2. This intended value modified by the force measurement for the position of the first ruler S1 is then compared during a renewed run through the regulating loop of the first ruler 2 with the measured position value of the first ruler 2. In the event that K2 is the lower of the forces K1 and K2, the force K2 or the force K' is supplied to the regulator R2. This regulator R2, in turn, issues a new intended position value S2 for the position of the second ruler 4. It is also possible that the value K' is transferred to both regulators R1 and R2 and that both regulators, R1 and R2, issue new intended values S1 and S2 corresponding to the measured force value K'. Preferably, the intended values S1 and S2 are issued by the regulators R1 and R2, such that the smaller of the measured forces K1, K2, i.e. the contact forces K1 and K2, is between a predeterminable lower limit, i.e. limit force and a predeterminable upper limit, i.e. limit force. The lower limit is preferably selected in such a way that the friction of the system, i.e. of the strip 1 can be overcome and, thus, the regulation can always influence the movements of the strip 1. The upper limit is preferably determined by plant parameters, such as the occurring frictional forces and can also depend on the desired measurement accuracy.

LIST OF REFERENCE NUMERALS

1 Metal strip
2 First ruler

3 First adjusting device
4 Second ruler
5 Second adjusting device
6 Force measurement pick-up
7 Position measurement pick-up
8 Pressure measuring pick-up
9 First guide edge
10 Second guide edge
K1 Force present at first ruler
K2 Force present at second ruler
K' Smaller of the measured forces K1, K2
MG1 Position measuring device of the first ruler
MG2 Position measuring device of the second ruler
MG1' Force measuring device of the first ruler
MG2' Force measuring device of the second ruler
P1 Position of the first ruler
P2 Position of the second ruler
R1 Regulator 1 for issuing the intended position value S1 for the first ruler
R2 Regulator 2 for issuing the intended position value S2 for the second ruler
RG1 Regulating member of the position regulating loop of the first ruler
RG2 Regulating member of the position regulating loop of the second ruler
RS1 Regulating system of the position regulating loop of the first ruler
RS2 Regulating system of the position regulating loop of the second ruler
S1 Intended value for the position of the first ruler
S2 Intended value for the position of the second ruler
SG1 Adjusting member of the position regulating loop of the first ruler
SG2 Adjusting member of the position regulating loop of the second ruler
Z1 Interference of the position regulating loop of the first ruler
Z2 Interference of the position regulating loop of the second ruler

The invention claimed is:

1. A method of regulating a lateral guide of a metal strip, wherein the lateral guide comprises a first ruler on one side of the metal strip and a second ruler on another side of the metal strip, the method comprising the steps of: moving the rulers independently of each other and driving each ruler in a position-regulated manner; measuring forces of the metal strip that act on the first ruler and the second ruler; and regulating an intended position for the first and/or for the second rulers in dependence on the forces measured at the first and at the second rulers, so that only a smaller value of the forces respectively measured at the first ruler and the second ruler is above a selectable lower limit force and below a selectable upper limit force whereby only the smaller value of the forces measured at the first and second rulers is used for regulating the intended position.

2. The method according to claim 1, wherein the upper limit force is greater than the lower limit force, the method including adjusting positions for the first and/or second rulers that the forces measured at the first and the second rulers are increased when the smaller value of the forces measured at the first ruler and the second ruler is below the lower limit force, and adjusting the positions for the first and/or second rulers are adjusted in such a way that the forces measured at the first and the second rulers are decreased if the smaller value of the forces measured at the first ruler and the second ruler is above the upper limit force.

3. The method according to claim 1, including filtering the measured forces with a low pass filter.

4. The method according to claim 1, including driving the first and the second rulers by a drive, at least one of the drives being carried out optionally hydraulically or pneumatically.

5. The method according to claim 4, wherein the hydraulic or pneumatic drives comprise a cylinder chamber, the method including determining the forces acting on the first or second ruler by pressures measured in the cylinder chamber.

6. The method according to claim 1, including driving the first and second rulers by a drive, at least one of the drives including an electric linear motor.

7. The method according to claim 6, including determining the force acting on the first and second rulers from measured electrical values of the linear motor.

8. The method according to claim 1, including driving the first and second rulers by a drive, wherein at least one of the drives being driven by a rotary motor and a spindle gear unit, wherein the rotary motor is driven hydraulically or pneumatically.

* * * * *